US007643987B2

(12) United States Patent
Graham, Jr.

(10) Patent No.: US 7,643,987 B2
(45) Date of Patent: Jan. 5, 2010

(54) VOICE CHANNEL CHAINING IN SOUND PROCESSORS

(75) Inventor: Ray Graham, Jr., Walnut Creek, CA (US)

(73) Assignee: LSI Corporation, Milpitas, CA (US)

( * ) Notice: Subject to any disclaimer, the term of this patent is extended or adjusted under 35 U.S.C. 154(b) by 1023 days.

(21) Appl. No.: 10/946,430

(22) Filed: Sep. 21, 2004

(65) Prior Publication Data

US 2006/0074691 A1 Apr. 6, 2006

(51) Int. Cl.
*G10L 21/00* (2006.01)

(52) U.S. Cl. ..... 704/200; 704/201

(58) Field of Classification Search ..... 704/200, 704/201

See application file for complete search history.

(56) References Cited

U.S. PATENT DOCUMENTS 5,331,633 A * 7/1994 Arai ..... 370/438
6,049,715 A * 4/2000 Willhoff et al. ..... 455/436
6,112,084 A * 8/2000 Sicher et al. ..... 370/337
6,192,029 B1 * 2/2001 Averbuch et al. ..... 370/229
6,215,864 B1 * 4/2001 Goyal et al. ..... 379/221.11
6,744,885 B1 * 6/2004 Ketchum et al. ..... 379/406.03
6,829,342 B2 * 12/2004 Nguyen et al. ..... 379/212.01
7,006,455 B1 * 2/2006 Fandrianto et al. ..... 370/260
7,050,549 B2 * 5/2006 Hannigan ..... 379/32.02
7,092,370 B2 * 8/2006 Jiang et al. ..... 370/329
7,242,677 B2 * 7/2007 Hong ..... 370/346
7,271,765 B2 * 9/2007 Stilp et al. ..... 342/457
7,400,905 B1 * 7/2008 Malkin et al. ..... 455/556.1
7,424,422 B2 * 9/2008 Graham, Jr. ..... 704/200

* cited by examiner

*Primary Examiner*—Susan McFadden
(74) *Attorney, Agent, or Firm*—William W. Cochran; Cochran Freund & Young LLC

(57) ABSTRACT

An improved method and apparatus for controlling the voice channels in sound processors includes: programming a first voice channel to instruct a second voice channel to execute an event when a trigger condition occurs; determining by the first voice channel that the trigger condition has occurred; and instructing the second voice channel to execute the event by the first voice channel. Thus, the need for the CPU to properly time the programmer's desired voice processing events is reduced by having the voice channels themselves be pre-instructed to control another voice channel(s) upon meeting a certain trigger condition. Chains of voice channels are possible and can be as simple or complex as desired. Accurate channel-to-channel event timing is thus possible. Since no interrupts or the polling of status registers is needed, the demands on CPU resources are reduced. System bus bandwidth is also freed for the use of other system components.

20 Claims, 4 Drawing Sheets

VOICE CHANNEL CHAINING IN SOUND PROCESSORS

FIELD OF THE INVENTION

The present invention relates to sound processors, and more particularly, to the control of voice channels in sound processors

BACKGROUND OF THE INVENTION

In today's sound processors, voice channels are used independently to initiate and control the fetching, interpretation, and processing of sound data which will ultimately be heard through speakers. Any given sound processor has a finite number of voices available.

Different voice channels are used to play different sounds, though not all voice channels are active at the same time. Most voice channels remain idle, and are pre-programmed to turn on (or "keyed on") when needed in order for the sound that they are responsible for to be played. In many situations one or more voice channels are to be keyed (or "keyed off") either immediately after another voice channel has completed or partway through that voice channel's processing.

One conventional approach is for the control software to poll status registers in the sound processor to determine the states of the voice channels. When the status registers indicate that a desired condition has been met, such as when a voice channel has completed, the software then instructs the next voice channel to key on. However, this approach requires heavy use of system bandwidth and clock cycles by constantly performing reads to the sound processor and then checking the returned result with a desire value. In addition, there is an inherent latency between the time the desired condition is met, and the time the control software polls the registers, discovers that the desired condition is met, and instructs the next voice channel.

Another convention approach sets up interrupt conditions so that the sound processor can send the central processing unit (CPU) an interrupt when the desired condition is met. The CPU then services the interrupt. However, this approach does not guarantee that the voice channels would be timed properly since interrupts are priority based. Other interrupts may have more importance than the sound processors, and thus latency still exists. In addition, the timing of the events is controlled by the CPU, and thus the programmer is still responsible for controlling the sound processor during operation.

The latency inherent in the convention approaches can result in undesired sound production or forces the programmer to use the sound processor in a different, possibly more time consuming way.

Accordingly, there exists a need for an improved method and apparatus for controlling the voice channels in sound processors. The improved method and apparatus should reduce latency in instructing a voice channel when a desired condition is met and should require fewer CPU resources. The present invention addresses such a need.

SUMMARY OF THE INVENTION

An improved method and apparatus for controlling the voice channels in sound processors includes: programming a first voice channel to instruct a second voice channel to execute an event when a trigger condition occurs; determining by the first voice channel that the trigger condition has occurred; and instructing the second voice channel to execute the event by the first voice channel. Thus, the need for the CPU to properly time the programmer's desired voice processing events is reduced by having the voice channels themselves be pre-instructed to control another voice channel(s) upon meeting a certain trigger condition. Chains of voice channels are possible and can be as simple or complex as desired. Accurate channel-to-channel event timing is thus possible. Since no interrupts or the polling of status registers is needed, the demands on CPU resources are reduced. System bus bandwidth is also freed for the use of other system components.

DETAILED DESCRIPTION

The present invention provides an improved method and apparatus for controlling the voice channels in sound processors. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

Figure 1:
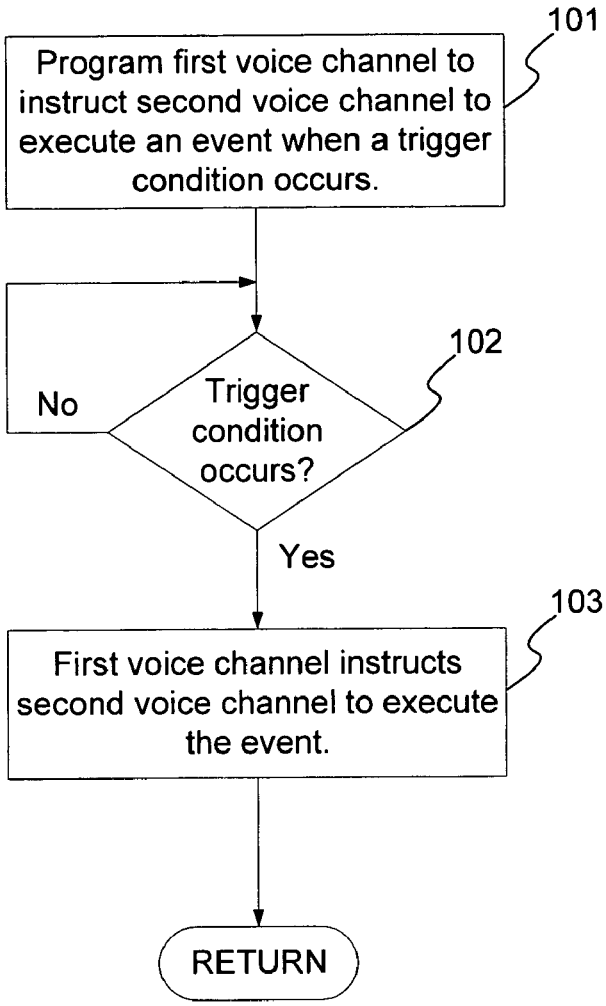
FIG. 1 is a flowchart illustrating a preferred embodiment of a method for controlling the voice channels in sound processors in accordance with the present invention.

FIG. 1 is a flowchart illustrating a preferred embodiment of a method for controlling the voice channels in sound processors in accordance with the present invention. First, a first voice channel is programmed to instruct a second voice channel to execute an event when a trigger condition occurs, via step 101. When the first voice channel determines that the trigger condition has occurred, via step 102, then it instructs the second voice channel to execute the event, via step 103. Thus, the present invention reduces the need for the CPU to properly time the programmer's desired voice processing events by having the voice channels themselves be pre-instructed to control another voice channel(s) upon meeting a certain trigger condition.

Figure 2:
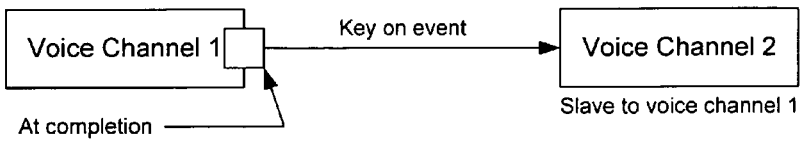
FIG. 2 illustrates a sound processor with at least two voice channels in accordance with the present invention.

For example, FIG. 2 illustrates a sound processor with at least two voice channels in accordance with the present invention. Voice channel 1 can be programmed such that when it completes, it immediately keys on voice channel 2. The control software does not have to control the timing of this event. The chained event behavior is initiated by the voice channels themselves. This guarantees that the desired event will happen at the desired moment. The chained event is initially programmed by the CPU (via software), and then the appropriate "master" voice channel, the one at the top of the chain, is keyed on.

In the preferred embodiment, the chains are defined by writing control data to specific control fields specified for each voice channel in the sound processor. In addition to any other control field for adequately fetching, processing, and playing a sound, the voice chaining further includes additional control fields:

1. Master flag: A flag specifying that the voice channel is a master and is responsible for controlling another voice channel.

2. Slave flag: A flag specifying that the voice channel is a slave and is allowed to receive instructions from another voice channel as part of a control chain.

3. Trigger type field: A field specifying a chain event trigger type. The sound processor's supported event trigger types can vary depending on what features it supports, and may include: (1) a frame/event count; (2) when a master voice channel is complete; (3) when a master voice channel is keyed on; (4) when a master voice channel is keyed off; (5) when a master voice's sound data fetch has reached a specific address; and (6) when a master voice channel has looped.

4. Trigger condition field: A field specifying the trigger condition based on the trigger type. This is relevant for trigger types (1) and (5) above. For example, when the trigger type is a frame count, the trigger condition is when this count reaches 0, the event is triggered. For another example, when the trigger type is the master channel sound data fetch reaching a specific address, the trigger condition is the address to compare to.

5. Affected voice channels field: A field specifying which voice channels are to be affected by the trigger. This field can vary in size based on either (a) how many voice channels the sound processor supports, or (b) how many voice channels are permitted to be chained. Each bit in the field controls one voice channel. For example, if the bit for voice channel 1 is set, then voice channel 1 is connected to the chain. If the bit is not set, then it is not connected to the chain.

6. Event field: Optionally, there can be a field specifying the event that is to occur for each voice channel that is controlled by this voice channel's trigger. The size of this field can vary based on (a) how many voice channels the sound processor supports; (b) how many voice channels are permitted to be chained; (c) if the voice channels in the chain can be controlled differently or are to be controlled in the same way, and/or (d) how many types of control options there are. In a typical sound processor, the voice channels can be "keyed on", "restarted", "keyed off", "stopped", "enabled", "disabled", "looped", and/or "paused". All of some of these control types can be specified in this field. This field is optional as the sound processor can be configured to only allow the chaining of one event type, such as "keyed on" control events.

7. Priority field: Optionally, there can be a field specifying the slave to master voice channel priority. If a voice channel is a slave to more than one master voice channels, and it is possible that the trigger condition can occur for more than one master voice channel at the same time, then the slave voice channel uses the priority set in this field to determine which master voice channel's trigger to execute.

Figure 3:
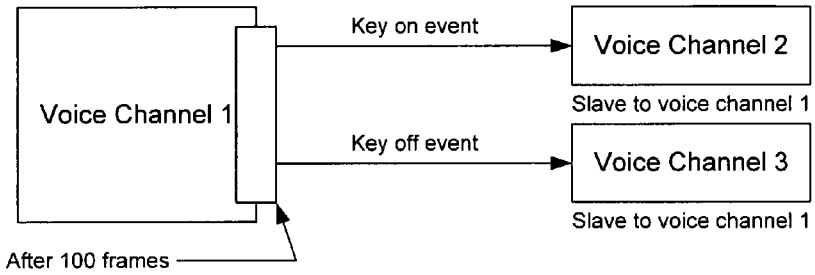
FIGS. 3 and 4 illustrate some example voice channels, chaining in accordance with the present invention.
Figure 4:
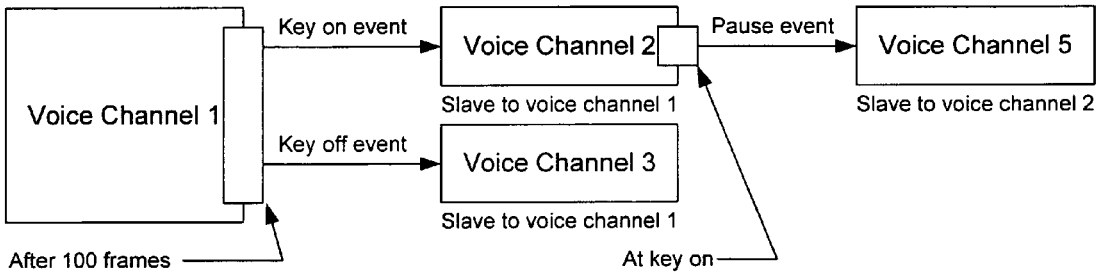
Figure 5:
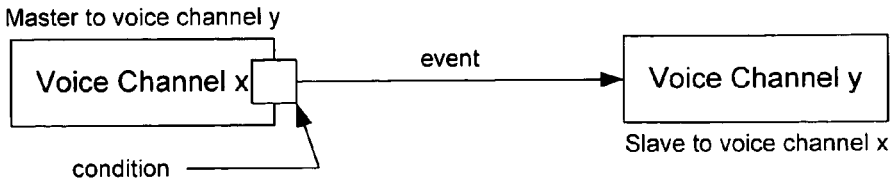
FIG. 5 through 9 illustrate possible chaining configuration types in accordance with the present invention.
Figure 6:
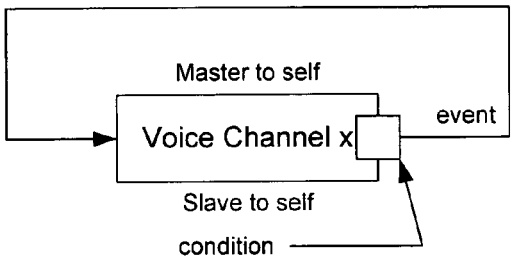
Figure 7:
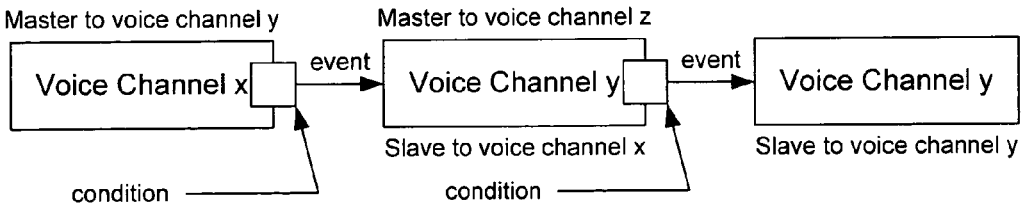
Figure 8:
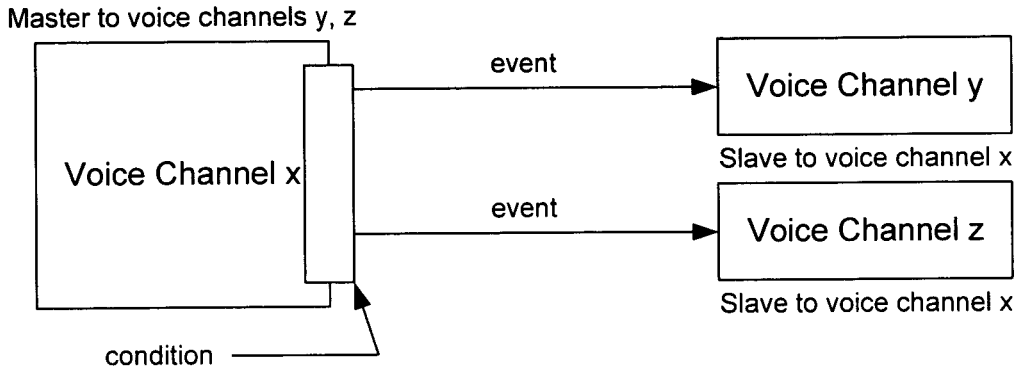

FIGS. 3 and 4 illustrate some example voice channels, chaining in accordance with the present invention. In FIG. 3, voice channel 1 is a master to voice channels 2 and 3. Thus, the master flag in voice channel 1 is set, and the slave flags in voice channels 2 and 3 are set. Here, voice channel 1 is programmed such that after 100 frames, voice channel 2 is keyed on and voice channel 3 is keyed off. Thus, in voice channel 1, the trigger type field specifies a frame count, and its trigger condition field specifies 100. The bits for voice channels 2 and 3 are set in the affected voice channels field. If the chain in deeper, as illustrated in FIG. 4, voice channel 2, which is a slave of voice channel 1, can be programmed such that when it is keyed on, voice channel 5 is paused. Both the master and slave flags in voice channel 2 would thus be set.

Figure 9:
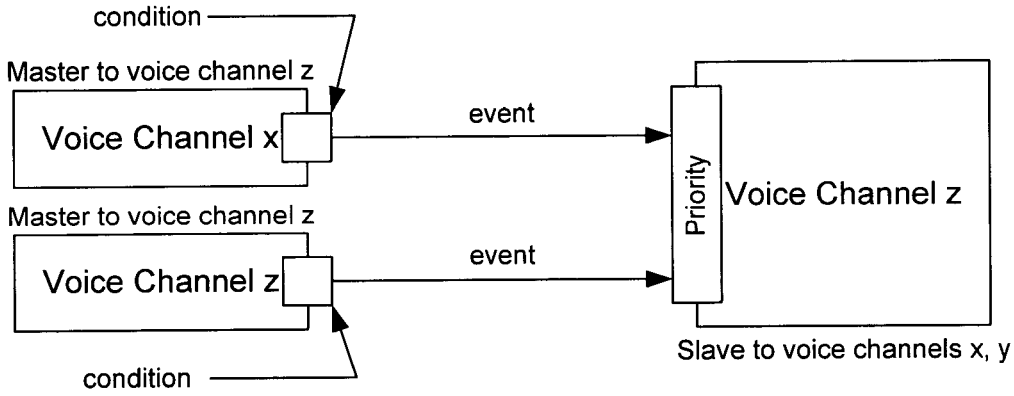

As illustrated in FIG. 5 through 9, several chaining configuration types are possible: a master voice channel x can have a single slave channel y (FIG. 5), and a slave voice channel y can have a single master voice channel x; a master voice channel x can be a slave to itself (FIG. 6); a slave voice channel y can also be a master to voice channel z, thus lengthening the chain (FIG. 7); a master voice channel x can have more than one slave voice channels y and z, thus forming a tree or a loop (FIG. 8); and a slave voice channel z can have more than one master slave channel x and y, thus forming a net (FIG. 9). Not all sound processors that practice the present invention need to support all of these configurations. If the sound processor supports the configuration illustrated in FIG. 9, then the priority field, described above, is necessary. If the two master voice channels x and y trigger the slave voice channel z to execute its programmed event at the same time (particularly if the event types differ), the slave voice channel z will be able to determine which master voice channel to ignore.

Optionally, in smaller sound processor architectures, only certain voice channels can be specified or permitted to be chainable. In addition, the fields specifying chaining behavior do not necessarily have to be tied to the specified voice channel control blocks. They can possibly be defined and held independently and/or stored in a global memory from which each voice channel can read its control data.

An improved method and apparatus for controlling the voice channels in sound processors have been disclosed. The method and apparatus reduces the need for the CPU to properly time the programmer's desired voice processing events by having the voice channels themselves be pre-instructed to control another voice channel(s) upon meeting a certain trigger condition. Chains of voice channels are possible and can be as simple or complex as desired. Accurate channel-to-channel event timing is thus possible. Since no interrupts or the polling of status registers is needed, the demands on CPU resources are reduced. System bus bandwidth is also freed for the use of other system components.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for controlling voice channels in a sound processor, comprising:

determining, in said sound processor, by a first voice channel having a memory storing a master flag, that a trigger condition has occurred, said sound processor having said first voice channel and a second voice channel that initiate and control the fetching, interpretation, and processing of sound data;

in response to determining that the trigger condition has occurred, causing, by the first voice channel, said second voice channel to execute an event.

2. The method of claim 1, wherein the trigger condition comprises one or more of the group consisting of:

a frame or event count;

a completion of an event by a master voice channel;

a keying on of a master voice channel;

a keying off of a master voice channel;

a master voice channel's sound data fetch reaching a specific address; and a looping of a master voice channel.

3. The method of claim 1, wherein the event comprises one or more of the group consisting of:

key on;
restart;
key off;
stop;
enable;
disable;
loop; and
pause.

4. The method of claim 1, further comprising: programming a single voice channel to instruct one or more voice channels to execute one or more events when the trigger condition occurs.

5. The method of claim 1, further comprising: programming one or more voice channels to instruct a single voice channel to execute the event when the trigger condition occurs.

6. The method of claim 1, wherein the first and second voice channels are a same voice channel.

7. A computer readable medium with program instructions for controlling voice channels in a sound processor, the program instructions which when executed by a computer system cause the computer system to execute a method comprising:

determining, in said sound processor, by a first voice channel, that a trigger condition has occurred, said sound processor having said first voice channel and a second voice channel that initiate and control the fetching, interpretation, and processing of sound data;

in response to determining that the trigger condition has occurred, causing, by the first voice channel, said second voice channel to execute an event.

8. The medium of claim 7, wherein the trigger condition comprises one or more of the group consisting of:

a frame or event count;
a completion of an event by a master voice channel;
a keying on of a master voice channel;
a keying off of a master voice channel;
a master voice channel's sound data fetch reaching a specific address; and
a looping of a master voice channel.

9. The medium of claim 7, wherein the event comprises one or more of the group consisting of:

key on;
restart;
key off;
stop;
enable;
disable;
loop; and
pause.

10. The medium of claim 7, further comprising: programming a single voice channel to instruct one or more voice channels to execute one or more events when the trigger condition occurs.

11. The medium of claim 7, further comprising: programming one or more voice channels to instruct a single voice channel to execute the event when the trigger condition occurs.

12. The medium of claim 7, wherein the first and second voice channels are a same voice channel.

13. A voice device comprising:

a processor; and a memory that stores a master flag, a slave flag, a trigger type field, and an affected voice channel field associated with a voice channel, wherein the master flag is set if the voice channel is to trigger an event at another voice channel, wherein the slave flag is set if the voice channel is allowed to receive the trigger of the event from another voice channel, wherein the trigger type field specifies an event trigger type, wherein the trigger condition field specifies a trigger condition based on the trigger type; and wherein the affected voice channel field specifies which voice channel is to be affected by the trigger of the event by the voice channel.

14. The voice channel of claim 13, wherein the event trigger type comprises one of a group consisting of:

a frame or event count;
a completion of an event by a master voice channel;
a keying on of a master voice channel;
a keying off of a master voice channel;
a master voice channel's sound data fetch reaching a specific address; and
a looping of a master voice channel.

15. The voice channel of claim 13, wherein the event comprises one or more of the group consisting of:

key on;
restart;
key off;
stop;
enable;
disable;
loop; and
pause.

16. The voice channel of claim 13, wherein a size of the affected voice channel field can vary based on a number of supported voice channels, if a plurality of supported voice channels can be controlled differently or in a same way, or a number of control options.

17. The voice channel of claim 13, wherein the affected voice channel comprises a plurality of voice channels.

18. The voice channel of claim 13, wherein the affected voice channel comprises the voice channel itself.

19. The voice channel of claim 13, further comprising:

an event field for specifying the event to be triggered by the voice channel.

20. The voice channel of claim 13, further comprising:

a priority field for specifying a master voice channel priority, if the voice channel receives a plurality of triggers from a plurality of master voice channels.

* * * * *